US010139746B2

(12) United States Patent
Azzam et al.

(10) Patent No.: US 10,139,746 B2
(45) Date of Patent: Nov. 27, 2018

(54) LIQUID ELECTROPHOTOGRAPHIC VARNISH COMPOSITION

(71) Applicant: HP Indigo B.V., Amstelveen (NL)

(72) Inventors: Tony Azzam, Nazareth (IL); Ilanit Mor, Kiryat Ono (IL); Albert Teishev, Rishon le-zion (IL); Guy Nesher, Nes Ziona (IL); Getahun Biadglin, Beth-She'an (IL); Haim Cohen, Modiin (IL); Samer Farran, Nes Ziona (IL); Nurit Carmel-Barnea, Nes Ziona (IL); Julia Kornilov, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 20 days.

(21) Appl. No.: 15/124,345

(22) PCT Filed: Mar. 25, 2014

(86) PCT No.: PCT/EP2014/055996
§ 371 (c)(1),
(2) Date: Sep. 7, 2016

(87) PCT Pub. No.: WO2015/144212
PCT Pub. Date: Oct. 1, 2015

(65) Prior Publication Data
US 2017/0108792 A1 Apr. 20, 2017

(51) Int. Cl.

| | |
|---|---|
| ***G03G 9/13*** | (2006.01) |
| ***G03G 13/054*** | (2006.01) |
| ***G03G 9/12*** | (2006.01) |
| ***G03G 15/00*** | (2006.01) |

(52) U.S. Cl.
CPC ..... *G03G 9/131* (2013.01); *G03G 9/12* (2013.01); *G03G 9/13* (2013.01); *G03G 9/132* (2013.01); *G03G 9/133* (2013.01); *G03G 13/054* (2013.01); *G03G 15/6585* (2013.01)

(58) Field of Classification Search
CPC ..... G03G 9/131; G03G 13/054; Y10T 428/24802
See application file for complete search history.

(56) References Cited

U.S. PATENT DOCUMENTS

| | | | |
|---|---|---|---|
| 5,356,748 | A | 10/1994 | Horie et al. |
| 6,174,640 | B1 | 1/2001 | Lawson |
| 6,447,973 | B1 | 9/2002 | Asami et al. |

(Continued)

FOREIGN PATENT DOCUMENTS

| | | |
|---|---|---|
| EP | 1973003 A1 | 9/2008 |
| JP | H03247678 | 11/1991 |

(Continued)

OTHER PUBLICATIONS

Digiguard Digital Printing Overprint Varnish, Michelman, 2014, 2 pages http://www.michelman.com/Products/DigiGuard/.

(Continued)

*Primary Examiner* — Betelhem Shewareged
(74) *Attorney, Agent, or Firm* — Dierker & Kavanaugh PC

(57) ABSTRACT

Herein is disclosed a liquid electrophotographic varnish composition comprising: a polymer resin; an epoxy-based cross-linking agent; a metal catalyst and/or a photo-initiator for catalyzing the cross-linking; and a carrier liquid.

19 Claims, 2 Drawing Sheets

(56) References Cited

U.S. PATENT DOCUMENTS

| | | | | |
|---|---|---|---|---|
| 2004/0076456 | A1* | 4/2004 | Tani | G03G 7/00 399/329 |
| 2004/0115561 | A1 | 6/2004 | Laksin et al. | |
| 2010/0055602 | A1 | 3/2010 | Teshima | |
| 2010/0068478 | A1* | 3/2010 | Humpert | G03G 9/12 428/195.1 |
| 2012/0067759 | A1 | 3/2012 | Seung | |
| 2015/0194376 | A1* | 7/2015 | Shimobe | H01L 23/3107 257/676 |

FOREIGN PATENT DOCUMENTS

| | | |
|---|---|---|
| WO | WO 00/66669 | 11/2000 |
| WO | WO 2007/130069 | 11/2007 |

OTHER PUBLICATIONS

Tagansky, Boaz. "HP-Indigo Technology and Its Application to Photo Printing" Society for Imaging Science and Technology, 2012, 4 pages.

International Search Report and Written Opinion for International Application No. PCT/EP2014/055996 dated Nov. 25, 2014, 9 pages.

* cited by examiner

LIQUID ELECTROPHOTOGRAPHIC VARNISH COMPOSITION

BACKGROUND

Electrostatic or electrophotographic printing processes typically involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate.

Overprint varnishes are known and are used to enhance appearance and protect printed materials.

DETAILED DESCRIPTION

Figure 1:
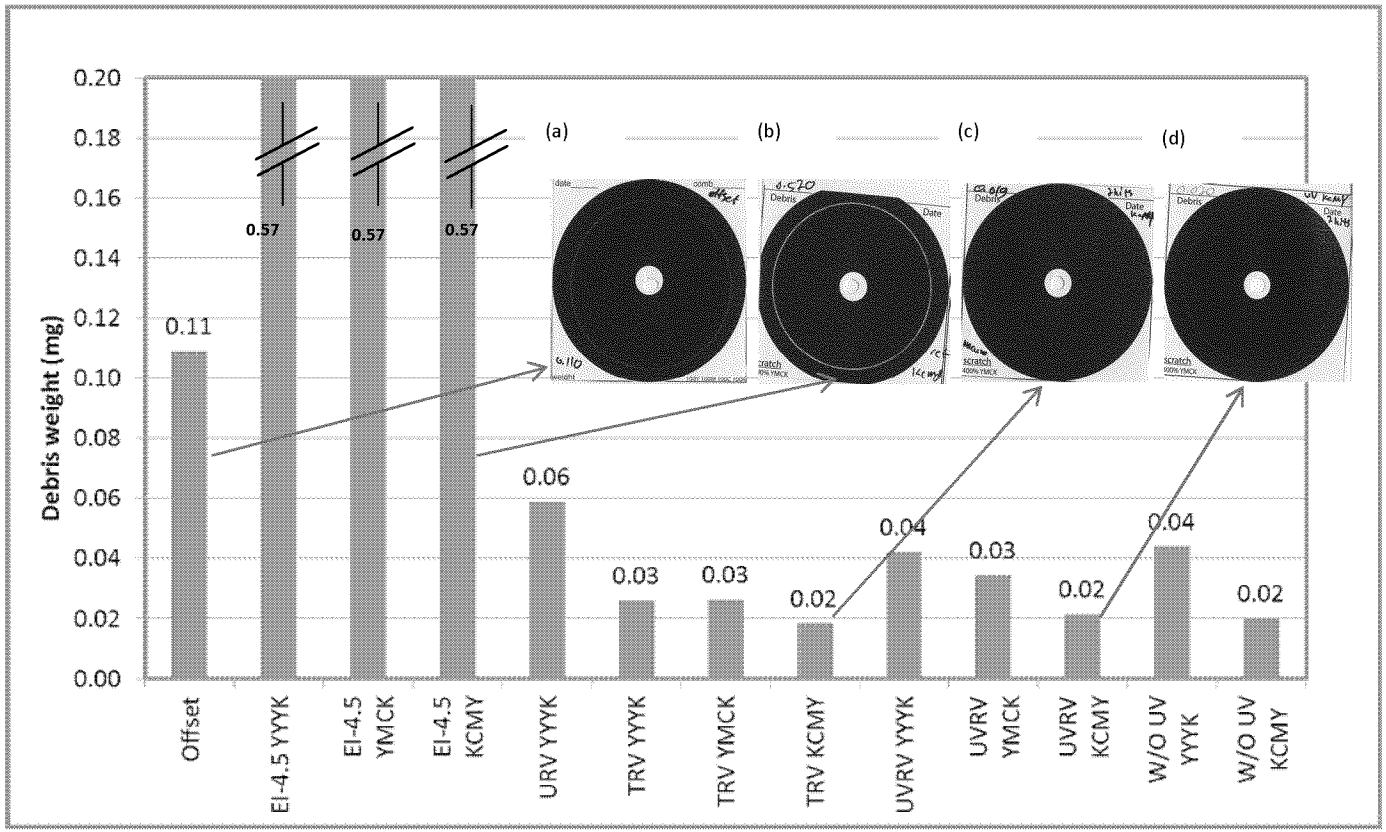
FIG. 1 shows the debris weights (amount of ink removed by the nail), obtained by the Taber® Shear instrument, for various varnish formulations printed on top of images.

Before the present disclosure is disclosed and described, it is to be understood that this disclosure is not limited to the particular process steps and materials disclosed herein because such process steps and materials may vary somewhat. It is also to be understood that the terminology used herein is used for the purpose of describing particular embodiments. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier fluid", "carrier liquid," "carrier," or "carrier vehicle" refers to the fluid in which the polymers, particles, colorant, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "liquid electrophotographic composition" generally refers to a composition, which may be in liquid or powder form, that is typically suitable for use in an electrophotographic printing process and which is free from pigment. The liquid electrophotographic composition may comprise chargeable particles of a resin, which may be as described herein, dispersed in a carrier liquid, which may be as described herein.

As used herein, "varnish" in the context of the present disclosure refers to substantially colourless, clear or transparent compositions substantially free from pigment. As the compositions are substantially free from pigment, they may be used as varnishes in the methods described herein without contributing a further subtractive effect on the CMYK inks that would substantially affect the colour of an underprinted coloured image. It will be understood that other effects such as gamut expansion, saturation and brightness nevertheless may be enhanced.

As used herein, "co-polymer" refers to a polymer that is polymerized from at least two monomers.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer, as known in the art. If a melt flow rate of a particular polymer is specified, unless otherwise stated, it is the melt flow rate for that polymer alone, in the absence of any of the other components of the electrostatic composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa-s or cPoise, as known in the art. Alternatively, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrostatic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly or indirectly via an intermediate transfer member to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid composition is employed in the electrophotographic process rather than a powder toner. An electrostatic printing process may involve subjecting the electrostatic composition to an electric field, e.g. an electric field having a field gradient of 50-400V/μm, or more, ins some examples 600-900V/μm, or more.

As used herein, "substituted" may indicate that a hydrogen atom of a compound or moiety is replaced by another atom such as a carbon atom or a heteroatom, which is part of a group referred to as a substituent. Substituents include, for example, alkyl, alkoxy, aryl, aryloxy, alkenyl, alkenoxy, alkynyl, alkynoxy, thioalkyl, thioalkenyl, thioalkynyl, thioaryl, etc.

As used herein, "heteroatom" may refer to nitrogen, oxygen, halogens, phosphorus, or sulfur.

As used herein, "alkyl", or similar expressions such as "alk" in alkaryl, may refer to a branched, unbranched, or cyclic saturated hydrocarbon group, which may, in some examples, contain from 1 to about 50 carbon atoms, or 1 to about 40 carbon atoms, or 1 to about 30 carbon atoms, or 1 to about 10 carbon atoms, or 1 to about 5 carbon atoms for example.

The term "aryl" may refer to a group containing a single aromatic ring or multiple aromatic rings that are fused together, directly linked, or indirectly linked (such that the different aromatic rings are bound to a common group such as a methylene or ethylene moiety). Aryl groups described herein may contain, but are not limited to, from 5 to about 50 carbon atoms, or 5 to about 40 carbon atoms, or 5 to 30 carbon atoms or more, and may be selected from, phenyl and naphthyl.

As used herein, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, wt % values are to be taken as referring to a weight-for-weight (w/w) percentage of solids in the varnish composition, and not including the weight of any carrier fluid present.

In an aspect, there is provided a liquid electrophotographic varnish composition comprising:

- a polymer resin;
- an epoxy-based cross-linking agent;
- a metal catalyst and/or a photo-initiator for catalysing the cross-linking; and
- a carrier fluid.

In an aspect, there is provided a method of manufacturing a liquid electrophotographic varnish composition, comprising mixing a carrier liquid, a polymer resin, an epoxy-based cross-linking agent; and a metal catalyst for catalysing the cross-linking, to form the liquid electrophotographic composition.

In an aspect, there is provided a method of electrophotographic printing, comprising printing the liquid electrophotographic varnish composition of the first aspect onto a substrate using a liquid electrophotographic printer.

In an aspect, there is provided a print substrate, having printed thereon an electrophotographic varnish composition comprising a polymer resin, a metal catalyst and/or a photoinitiator and an epoxy-based cross-linking agent such that the polymer resin is cross-linked.

The present inventors have found that a varnish composition comprising an epoxy-based cross-linking agent and a metal catalyst for catalysing the cross-linking results in a varnish composition which is compatible with existing electrostatic printing processes and protects an underlying print image. The metal catalyst enables partial to full thermal curing of the protective digital varnish on the blanket before the printed materials are transferred to the print substrate. The present inventors have also found that a varnish composition comprising the same epoxy-based cross-linking catalyst and a photo-initiator can be cured using UV radiation after the composition has been transferred to the print substrate. The cross-linked polymer resin overlying the print image improves the scratch resistance and durability of the printed materials.

Unless otherwise stated, any feature described herein can be combined with any aspect or any other feature described herein.

Cross-Linking Agent

In some examples, the epoxy-based crosslinking agent has a molecular weight of more than 5000 Daltons. In some examples, the epoxy-based crosslinking agent has a molecular weight of 5000 Daltons or less, in some examples 4000 Daltons or less, in some examples, 3000 Daltons or less, in some examples 1500 Daltons or less, in some examples a molecular weight of 1000 Daltons or less, in some examples a molecular weight of 700 Daltons or less, in some examples a molecular weight of 600 Daltons or less. In some examples, the crosslinking agent has a molecular weight of from 100 to 1500 Daltons, in some examples, in some examples a molecular weight of from 100 to 600 Daltons.

In one example, the epoxy-based crosslinking agent may be of the formula (I), $$(X)—(Y—[Z—F]_m)_n \qquad \text{formula (I)}$$

wherein, in each $(Y—[Z—F]_m)_n$, Y, Z and F are each independently selected, such that F is an epoxide, e.g. group of the formula —CH(O)CR$^1$H, wherein R$^1$ is selected from H and alkyl;

Z is alkylene,

Y is selected from (i) a single bond, —O—, —C(=O)—O—, —O—C(=O)— and m is 1 or (ii) Y is —$NH_{2-m}$, wherein m is 1 or 2, n is at least 1, in some examples at least 2, in some examples at least 3, in some examples 1 to 4, in some examples 2 to 4, and X is an organic group.

In some examples, the crosslinking agent of formula (I) has at least two F groups, in some examples at least three F groups, in some examples at least four F groups.

X may comprise or be an organic group selected from optionally substituted alkyl, optionally substituted aryl, optionally substituted arylalkyl, optionally substituted alkylaryl, isocyanurate, and a polysiloxane. X may comprise one or more polymeric components; in some examples the polymeric components may be selected from a polysiloxane (such as poly(dimethyl siloxane), a polyalkylene (such as polyethylene or polypropylene), an acrylate (such as methyl acrylate) and a poly(alkylene glycol) (such as poly(ethylene glycol) and poly(propylene glycol)), and combinations thereof. In some examples X comprises a polymeric backbone, comprising a plurality of repeating units, each of which is covalently bonded to $(Y—[Z—F]_m)$, with Y, Z, F and m as described herein. X may be selected from a group selected from trimethyl propane, a branched or straight-chain $C_{1-5}$ alkyl, phenyl, methylene bisphenyl, trisphenylmethane, cyclohexane, isocyanurate.

In some examples, X is selected from (i) an alkane, which may be an optionally substituted straight chain, branched or cyclo-alkane, (ii) a cyclo alkane having at least two substitutents that are $Y—[Z—F]_m$ and (iii) an aryl (such as phenyl). In some examples, X is selected from (i) a branched alkane, with at least at least two of the alkyl branches covalently bonded to $(Y—[Z—F]_m)$ and (ii) a cyclo alkane having at least two substitutents that are $Y—[Z—F]_m$ and (iii) an aryl (such as phenyl) having at least two substituents that are $Y—[Z—F]_m$; Y is selected from (i) —O—, —C(=O)—O—, —O—C(=O)— and m is 1 or (ii) Y is —$NH_{2-m}$, wherein m is 1 or 2; Z is $C_{1-4}$ alkylene; F is an epoxide of the formula —CH(O)CR$^1$H, wherein R$^1$ is selected from H and methyl, and in some examples F is an epoxide of the formula —CH(O)CR$^1$H in which R$^1$ is H.

In some examples, X is trimethyl propane, in which three methyl groups are each substituted with a $(Y—[Z—F]_m)$ group (i.e. n is 3), in which Y is selected from —O—, —C(=O)—O—, —O—C(=O)— and m is 1, Z is Z is $C_{1-4}$ alkylene, in some examples methylene (—$CH_2$—) or ethylene (—$CH_2$—$CH_2$—); F is an epoxide of the formula —CH(O)CR$^1$H, wherein R$^1$ is selected from H and methyl, and in some examples F is an epoxide of the formula —CH(O)CR$^1$H in which R$^1$ is H.

In some examples, X is phenyl having at least two substituents that are $(Y—[Z—F]_m)$ groups, in which each Y is independently selected from (i) —O—, —C(=O)—O—, —O—C(=O)— and m is 1 or (ii) Y is —$NH_2$-m, wherein m is 1 or 2; Z is $C_{1-4}$ alkylene, in some examples methylene or ethylene; F is an epoxide of the formula —CH(O)CR$^1$H, wherein R$^1$ is selected from H and methyl, and in some examples F is an epoxide of the formula —CH(O)CR$^1$H in which R$^1$ is H.

In some examples, Z—F is an epoxycycloalkyl group. In some examples, Z—F is an epoxycyclohexyl group. In some examples, the crosslinking agent comprises two or more epoxycycloalkyl groups, in some examples two or more epoxycyclohexyl groups. In some examples, the crosslinking agent comprises two or more two or more epoxycycloalkyl groups, which are bonded to one another via a linker species; and the linker species may be selected from a single bond, optionally substituted alkyl, optionally substituted aryl, optionally substituted arylalkyl, optionally substituted alkylaryl, isocyanurate, a polysiloxane, —O—, —C(=O)—O—, —O—C(=O)—, and amino and combinations thereof. In some examples, in formula (I) Y is a single bond, X is an organic group of the formula —$X^1$-Q-$X^2$—, wherein $X^1$, $X^2$ are each independently selected from a single bond and alkyl, and Q is selected from alkyl, —O—, —C(=O)—O—, —O—C(=O)—, and amino; n is 2; m is 1 and Z—F is an epoxycycloalkyl group, in some examples Z—F is an epoxycyclohexyl group. In some examples, in formula (I) Y is a single bond, X is an organic group of the formula —$X^1$-Q-$X^2$—, wherein $X^1$, $X^2$ are each independently selected from a single bond and $C_{1-4}$ alkyl, and Q is selected from $C_{1-4}$ alkyl, —O—, —C(=O)—O—, —O—C(=O)—; n is 2; m is 1 and Z—F is an epoxycyclohexyl group, optionally a 3,4 epoxycyclohexylgroup. In some examples, Y is a single bond, X is an organic group of the formula —$X^1$-Q-$X^2$—, wherein one of $X^1$ and $X^2$ is a single bond and the other of $X^1$ and $X^2$ is $C_{1-4}$ alkyl, and Q is selected —O—, —C(=O)—O—, —O—C(=O)—; n is 2; m is 1 and Z—F is an epoxycyclohexyl group, optionally a 3,4 epoxycyclohexylgroup.

In some examples, the crosslinking agent is selected from 1,2,7,8-diepoxy octane, trimethylolpropane triglycidyl ether, resorcinol diglycidyl ether, N,N-diglycidyl-4-glycidyloxyaniline, 4,4'-methylenebis(N, N-diglycidylaniline), tris(4-hydroxyphenyl)methane triglycidyl ether, diglycidyl 1,2-cyclohexanedicarboxylate, 1,4-cyclohexanedimethanol diglycidyl ether (which may be mixture of cis and trans), tris(2,3-epoxypropyl) isocyanurate, neopentyl glycol diglycidyl ether, bisphenol A diglycidyl ether, bisphenol A propoxylate diglycidyl ether, 3,4-epoxycyclohexylmethyl 3,4-epoxycyclohexanecarboxylate, poly[(o-cresyl glycidyl ether)-co-formaldehyde], poly(ethylene-co-glycidyl methacrylate), poly(ethylene-co-methyl acrylate-co-glycidyl methacrylate), poly(bisphenol A-co-epichlorohydrin) glycidyl end-capped, poly(ethylene glycol) diglycidyl ether, poly(propylene glycol) diglycidyl ether).

In some examples, the epoxy-based cross-linking agent is inactive at ambient or room temperature. In some examples, the epoxy-based cross-linking agent is highly reactive at a temperature above ambient temperature. In some examples, the epoxy-based cross-linking agent is highly reactive at a temperature greater than about 50° C., for example greater than about 60° C., for example greater than about 70° C., for example greater than about 80° C., for example greater than about 90° C., for example greater than about 100° C., for example about 110° C.

In some examples, the epoxy-based cross-linking agent is compatible with the carrier liquid of the varnish composition. In one example, the epoxy-based cross-linking agent is soluble in the carrier liquid of the varnish composition. In one example, the cross-linking agent is 3,4-epoxycyclohexylmethyl 3,4-epoxycyclohexanecarboxylate.

Metal Catalyst

In some examples, the varnish composition comprises a metal catalyst to catalyse the cross-linking of the polymer resin with the epoxy-based cross-linking agent. The metal catalyst may be activated by thermal energy. In some examples, the metal catalyst may be substantially inactive at ambient or room temperature by which will be understood that the metal catalyst does not catalyse the cross-linking reaction. In some examples, the metal catalyst may be activated at temperatures greater than 50° C., for example greater than greater than 60° C., greater than 70° C., greater than 80° C., greater than 90° C., greater than 100° C., for example about 110° C. In some examples, the metal catalyst may be activated by the thermal energy of the intermediate transfer member, or blanket.

In one example, the metal catalyst may be present in an amount sufficient to catalyse cross-linking of the polymer resin with the epoxy-based cross-linking agent. In one example, the metal catalyst may be present in an amount sufficient to catalyse cross-linking of the polymer resin with the epoxy-based cross-linking agent whilst the varnish composition is being transferred on the intermediate transfer member, or blanket. In some examples, the metal catalyst may be present in an amount of less than 5 wt %, for example less than 4 wt %, for example less than 3 wt %, for example less than 2 wt %, for example less than 1 wt %, for example 0.5 wt % or less.

In some examples the metal catalyst is any catalyst that is capable of promoting cross-linking of an epoxy-based system. In some examples, the metal catalyst is a chromium complex, for example a chromium (III) complex or a chromium (VI) complex. In some examples, the metal catalyst is a zinc complex, for example a zinc (I) complex or a zinc (II) complex. Examples of suitable catalysts include the NACURE series of catalysts from King Industries, Inc., for example NACURE XC-259, the K-PURE series of catalysts, also from King Industries, Inc., for example K-PURE CXC-1765, and the HYCAT series of catalysts from Dimension Technologies Chemical Systems, Inc., for example HYCAT 2000S.

Photo-Initiator

In some examples, the varnish composition comprises a photo-initiator. The photo-initiator, or UV initiator, is an agent that initiates a reaction upon exposure to a desired wavelength of UV light to cure the composition, as described herein, after its application to a substrate by cross-linking the polymer resin with the epoxy-based cross-linking agent. In some examples, the photo-initiator is a cationic photo-initiator or a radical photo-initiator. The photo-initiator may be a single compound or a mixture of two or more compounds. It can be present in the composition in an amount sufficient to cure the applied composition. In some examples, the photo-initiator is present in the composition in an amount representing from about 0.01 to about 10 wt %, or from about 1 to about 5 wt %. In one example the photo-initiator may be present in an amount of less than 5 wt %, for example less than 4 wt %, less than 3 wt %, less than 2 wt %, less than 1 wt %.

In some examples, the photo-initiator is a cationic photo-initiator. Suitable examples of cationic photo-initiators are ESACURE 1064 (50% propylene carbonate solution of arylsulfonium hexafluorophosphate (mono+di) salts); diphenyliodonium nitrate; (tert-butoxycarbonylmethoxynaphthyl)-diphenylsulfonium triflate; 1-naphthyl diphenylsulfonium triflate; (4-fluorophenyl)diphenylsulfonium triflate; Boc-methoxyphenyldiphenylsulfonium triflate (all available from Sigma-Aldrich).

Examples of radical photo-initiator include, by way of illustration and not limitation, 1-hydroxy-cyclohexylphenylketone, benzophenone, 2,4,6-trimethylbenzo-phenone, 4-methylbenzophenone, diphenyl-(2,4,6-trimethylbenzoyl) phosphine oxide, phenyl bis(2,4,6-trimethylbenzoyl)phosphine oxide, 2-hydroxy-2-methyl-1-phenyl-1-propanone, benzyl-dimethyl ketal, 2-methyl-1-[4-(methylthio)phenyl]-2-morpholinopropan-1-one, or combinations of two or more of the above. Amine synergists may also be used, such as, for example, ethyl-4-dimethylaminobenzoate, 2-ethylhexyl-4-dimethylamino benzoate.

The varnish composition may include a UV stabilizer, i.e. an agent that can assist with scavenging free radicals. Examples of UV stabilizers include, by way of illustration and not limitation, quinine methide (Irgastabe® UV 22 from BASF Corporation) and Genorade® 16 (Rahn USA Corporation) and combinations thereof.

In some examples, a photosensitizer may be used with the photo-initiator in amounts ranging from about 0.01 to about 10 wt %, or from about 1 to about 5 wt %, based on the total weight of the varnish composition. A photosensitizer absorbs energy and then transfers it to another molecule, usually the photo-initiator. Photosensitizers are often added to shift the light absorption characteristics of a system. Suitable examples of photosensitizers include, but are not limited to thioxanthone, 2-isopropylthioxanthone and 4-isopropylthioxanthone.

Carrier Liquid

In some examples, the varnish is or has been formed from an electrostatic varnish composition. Before application to the print substrate in the electrostatic printing process, the varnish may be an electrostatic varnish composition, which may be in dry form, for example in the form of flowable particles comprising the thermoplastic resin. Alternatively, before application to the print substrate in the electrostatic printing process, the electrostatic varnish composition may be in liquid form; and may comprises a carrier liquid in which is suspended particles of the thermoplastic resin. Generally, the carrier liquid can act as a dispersing medium for the other components in the electrostatic varnish composition. For example, the carrier liquid can comprise or be a hydrocarbon, silicone oil, vegetable oil, etc. The carrier liquid can include, but is not limited to, an insulating, non-polar, non-aqueous liquid that can be used as a medium for toner particles. The carrier liquid can include compounds that have a resistivity in excess of about $10^9$ ohm-cm. The carrier liquid may have a dielectric constant below about 5, in some examples below about 3. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the carrier liquids include, but are not limited to, aliphatic hydrocarbons, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100®, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

Before printing, the carrier liquid can constitute about 20% to 99.5% by weight of the electrostatic varnish composition, in some examples 50% to 99.5% by weight of the electrostatic varnish composition. Before printing, the carrier liquid may constitute about 40 to 90% by weight of the electrostatic varnish composition. Before printing, the carrier liquid may constitute about 60% to 80% by weight of the electrostatic varnish composition. Before printing, the carrier liquid may constitute about 90% to 99.5% by weight of the electrostatic varnish composition, in some examples 95% to 99% by weight of the electrostatic varnish composition.

The varnish, when printed on the print substrate, may be substantially free from carrier liquid. In an electrostatic printing process and/or afterwards, the carrier liquid may be removed, e.g. by an electrophoresis processes during printing and/or evaporation, such that substantially just solids are transferred to the print substrate. Substantially free from carrier liquid may indicate that the varnish printed on the print substrate contains less than 5 wt % carrier liquid, in some examples, less than 2 wt % carrier liquid, in some examples less than 1 wt % carrier liquid, in some examples less than 0.5 wt % carrier liquid. In some examples, the varnish printed on the print substrate is free from carrier liquid.

Polymer Resin

The varnish composition can comprise a polymer resin. The polymer resin may comprise a thermoplastic polymer. A thermoplastic polymer is sometimes referred to as a thermoplastic resin. In some examples, the polymer may be selected from ethylene or propylene acrylic acid co-polymers; ethylene or propylene methacrylic acid co-polymers; ethylene vinyl acetate co-polymers; co-polymers of ethylene or propylene (e.g. 80 wt % to 99.9 wt %), and alkyl (e.g. C1 to C5) ester of methacrylic or acrylic acid (e.g. 0.1 wt % to 20 wt %); co-polymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); co-polymers of ethylene or propylene (e.g. 70 wt % to 99.9 wt %) and maleic anhydride (e.g. 0.1 wt % to 30 wt %); polyethylene; polystyrene; isotactic polypropylene (crystalline); co-polymers of ethylene ethylene ethyl acrylate; polyesters; polyvinyl toluene; polyamides; styrene/butadiene co-polymers; epoxy resins; acrylic resins (e.g. co-polymer of acrylic or methacrylic acid and at least one alkyl ester of acrylic or methacrylic acid wherein alkyl may have from 1 to about 20 carbon atoms, such as methyl methacrylate (e.g. 50% to 90%)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may comprise a polymer having acidic side groups. Examples of the polymer having acidic side groups will now be described. The polymer having acidic side groups may have an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. The polymer having acidic side groups may have an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures known in the art, for example using the procedure described in ASTM D1386.

The resin may comprise a polymer, in some examples a polymer having acidic side groups, that has a melt flow rate of less than about 70 g/10 minutes, in some examples about 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less. In some examples, all polymers having acidic side groups and/or ester groups in the particles each individually have a melt flow rate of less than 90 g/10 minutes, 80 g/10 minutes or less, in some examples 80 g/10 minutes or less, in some examples 70 g/10 minutes or less, in some examples 70 g/10 minutes or less, in some examples 60 g/10 minutes or less.

The polymer having acidic side groups can have a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. The polymer having acidic side groups can have a melt flow rate of, in some examples, about 50 g/10 minutes to about 120 g/10 minutes, in some examples 60 g/10 minutes to about 100 g/10 minutes. The melt flow rate can be measured using standard procedures known in the art, for example as described in ASTM D1238.

The acidic side groups may be in free acid form or may be in the form of an anion and associated with one or more counterions, typically metal counterions, e.g. a metal selected from the alkali metals, such as lithium, sodium and potassium, alkali earth metals, such as magnesium or calcium, and transition metals, such as zinc. The polymer having acidic sides groups can be selected from resins such as co-polymers of ethylene and an ethylenically unsaturated acid of either acrylic acid or methacrylic acid; and ionomers thereof, such as methacrylic acid and ethylene-acrylic or methacrylic acid co-polymers which are at least partially neutralized with metal ions (e.g. Zn, Na, Li) such as SURLYN® ionomers. The polymer comprising acidic side groups can be a co-polymer of ethylene and an ethylenically unsaturated acid of either acrylic or methacrylic acid, where the ethylenically unsaturated acid of either acrylic or methacrylic acid constitute from 5 wt % to about 25 wt % of the co-polymer, in some examples from 10 wt % to about 20 wt % of the co-polymer.

The resin may comprise two different polymers having acidic side groups. The two polymers having acidic side groups may have different acidities, which may fall within the ranges mentioned above. The resin may comprise a first polymer having acidic side groups that has an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has an acidity of 110 mg KOH/g to 130 mg KOH/g.

The resin may comprise two different polymers having acidic side groups: a first polymer having acidic side groups that has a melt flow rate of about 10 g/10 minutes to about 50 g/10 minutes and an acidity of from 10 mg KOH/g to 110 mg KOH/g, in some examples 20 mg KOH/g to 110 mg KOH/g, in some examples 30 mg KOH/g to 110 mg KOH/g, in some examples 50 mg KOH/g to 110 mg KOH/g, and a second polymer having acidic side groups that has a melt flow rate of about 50 g/10 minutes to about 120 g/10 minutes and an acidity of 110 mg KOH/g to 130 mg KOH/g. The first and second polymers may be absent of ester groups.

The ratio of the first polymer having acidic side groups to the second polymer having acidic side groups can be from about 10:1 to about 2:1. The ratio can be from about 6:1 to about 3:1, in some examples about 4:1.

The resin may comprise a polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; said polymer may be a polymer having acidic side groups as described herein. The resin may comprise a first polymer having a melt viscosity of 15000 poise or more, in some examples 20000 poise or more, in some examples 50000 poise or more, in some examples 70000 poise or more; and in some examples, the resin may comprise a second polymer having a melt viscosity less than the first polymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The resin may comprise a first polymer having a melt viscosity of more than 60000 poise, in some examples from 60000 poise to 100000 poise, in some examples from 65000 poise to 85000 poise; a second polymer having a melt viscosity of from 15000 poise to 40000 poise, in some examples 20000 poise to 30000 poise, and a third polymer having a melt viscosity of 15000 poise or less, in some examples a melt viscosity of 10000 poise or less, in some examples 1000 poise or less, in some examples 100 poise or less, in some examples 50 poise or less, in some examples 10 poise or less; an example of the first polymer is Nucrel 960 (from DuPont), and example of the second polymer is Nucrel 699 (from DuPont), and an example of the third polymer is AC-5120 or AC-5180 (from Honeywell). The first, second and third polymers may be polymers having acidic side groups as described herein. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

If the resin in the varnish composition comprises a single type of polymer, the polymer (excluding any other components of the electrostatic varnish composition) may have a melt viscosity of 6000 poise or more, in some examples a melt viscosity of 8000 poise or more, in some examples a melt viscosity of 10000 poise or more, in some examples a melt viscosity of 12000 poise or more. If the resin comprises a plurality of polymers all the polymers of the resin may together form a mixture (excluding any other components of the electrostatic varnish composition) that has a melt viscosity of 6000 poise or more, in some examples a melt viscosity of 8000 poise or more, in some examples a melt viscosity of 10000 poise or more, in some examples a melt viscosity of 12000 poise or more. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The resin may comprise two different polymers having acidic side groups that are selected from co-polymers of ethylene and an ethylenically unsaturated acid of either acrylic acid or methacrylic acid; or ionomers thereof, such as methacrylic acid and ethylene-acrylic or methacrylic acid co-polymers which are at least partially neutralized with metal ions (e.g. Zn, Na, Li) such as SURLYN® ionomers. The resin may comprise (i) a first polymer that is a co-polymer of ethylene and an ethylenically unsaturated acid of either acrylic acid and methacrylic acid, wherein the ethylenically unsaturated acid of either acrylic or methacrylic acid constitutes from 8 wt % to about 16 wt % of the co-polymer, in some examples 10 wt % to 16 wt % of the co-polymer; and (ii) a second polymer that is a co-polymer of ethylene and an ethylenically unsaturated acid of either acrylic acid and methacrylic acid, wherein the ethylenically unsaturated acid of either acrylic or methacrylic acid constitutes from 12 wt % to about 30 wt % of the co-polymer, in some examples from 14 wt % to about 20 wt % of the co-polymer, in some examples from 16 wt % to about 20 wt % of the co-polymer in some examples from 17 wt % to 19 wt % of the co-polymer.

The resin may comprise a polymer having acidic side groups, as described above (which may be free of ester side groups), and a polymer having ester side groups. The polymer having ester side groups may be a thermoplastic polymer. The polymer having ester side groups may further comprise acidic side groups. The polymer having ester side groups may be a co-polymer of a monomer having ester side groups and a monomer having acidic side groups. The polymer may be a co-polymer of a monomer having ester side groups, a monomer having acidic side groups, and a monomer absent of any acidic and ester side groups. The monomer having ester side groups may be a monomer selected from esterified acrylic acid or esterified methacrylic acid. The monomer having acidic side groups may be a monomer selected from acrylic or methacrylic acid. The monomer absent of any acidic and ester side groups may be an alkylene monomer, including, but not limited to, ethylene or propylene. The esterified acrylic acid or esterified methacrylic acid may, respectively, be an alkyl ester of acrylic acid or an alkyl ester of methacrylic acid. The alkyl group in the alkyl ester of acrylic or methacrylic acid may be an alkyl group having 1 to 30 carbons, in some examples 1 to 20 carbons, in some examples 1 to 10 carbons; in some examples selected from methyl, ethyl, iso-propyl, n-propyl, t-butyl, iso-butyl, n-butyl and pentyl.

The polymer having ester side groups may be a co-polymer of a first monomer having ester side groups, a second monomer having acidic side groups and a third monomer which is an alkylene monomer absent of any acidic and ester side groups. The polymer having ester side groups may be a co-polymer of (i) a first monomer having ester side groups selected from esterified acrylic acid or esterified methacrylic acid, in some examples an alkyl ester of acrylic or methacrylic acid, (ii) a second monomer having acidic side groups selected from acrylic or methacrylic acid and (iii) a third monomer which is an alkylene monomer selected from ethylene and propylene. The first monomer may constitute 1% to 50% by weight of the co-polymer, in some examples 5% to 40% by weight, in some examples 5% to 20% by weight of the co-polymer, in some examples 5% to 15% by weight of the co-polymer. The second monomer may constitute 1% to 50% by weight of the co-polymer, in some examples 5% to 40% by weight of the co-polymer, in some examples 5% to 20% by weight of the co-polymer, in some examples 5% to 15% by weight of the co-polymer. The first monomer can constitute 5% to 40% by weight of the co-polymer, the second monomer constitutes 5% to 40% by weight of the co-polymer, and with the third monomer constituting the remaining weight of the co-polymer. In some examples, the first monomer constitutes 5% to 15% by weight of the co-polymer, the second monomer constitutes 5% to 15% by weight of the co-polymer, with the third monomer constituting the remaining weight of the co-polymer. In some examples, the first monomer constitutes 8% to 12% by weight of the co-polymer, the second monomer constitutes 8% to 12% by weight of the co-polymer, with the third monomer constituting the remaining weight of the co-polymer. In some examples, the first monomer constitutes about 10% by weight of the co-polymer, the second monomer constitutes about 10% by weight of the co-polymer, and with the third monomer constituting the remaining weight of the co-polymer. The polymer may be selected from the Bynel® class of monomer, including Bynel 2022 and Bynel 2002, which are available from DuPont®.

The polymer having ester side groups may constitute 1% or more by weight of the total amount of the resin polymers, e.g. thermoplastic resin polymers, in the liquid electrophotographic varnish composition and/or the varnish printed on the print substrate, e.g. the total amount of the polymer or polymers having acidic side groups and polymer having ester side groups. The polymer having ester side groups may constitute 5% or more by weight of the total amount of the resin polymers, e.g. thermoplastic resin polymers, in some examples 8% or more by weight of the total amount of the resin polymers, e.g. thermoplastic resin polymers, in some examples 10% or more by weight of the total amount of the resin polymers, e.g. thermoplastic resin polymers, in some examples 15% or more by weight of the total amount of the resin polymers, e.g. thermoplastic resin polymers, in some examples 20% or more by weight of the total amount of the resin polymers, e.g. thermoplastic resin polymers, in some examples 25% or more by weight of the total amount of the resin polymers, e.g. thermoplastic resin polymers, in some examples 30% or more by weight of the total amount of the resin polymers, e.g. thermoplastic resin polymers, in some examples 35% or more by weight of the total amount of the resin polymers, e.g. thermoplastic resin polymers, in the liquid electrophotographic composition and/or the varnish printed on the print substrate. The polymer having ester side groups may constitute from 5% to 50% by weight of the total amount of the resin polymers, e.g. thermoplastic resin polymers, in the liquid electrophotographic composition and/or the varnish printed on the print substrate, in some examples 10% to 40% by weight of the total amount of the resin polymers, e.g. thermoplastic resin polymers, in the liquid electrophotographic composition and/or the varnish printed on the print substrate, in some examples 5% to 30% by weight of the total amount of the resin polymers, e.g. thermoplastic resin polymers, in the liquid electrophotographic composition and/or the varnish printed on the print substrate, in some examples 5% to 15% by weight of the total amount of the resin polymers, e.g. thermoplastic resin polymers, in the liquid electrophotographic composition and/or the varnish printed on the print substrate in some examples 15% to 30% by weight of the total amount of the resin polymers, e.g. thermoplastic resin polymers, in the liquid electrophotographic composition and/or the varnish printed on the print substrate.

The polymer having ester side groups may have an acidity of 50 mg KOH/g or more, in some examples an acidity of 60 mg KOH/g or more, in some examples an acidity of 70 mg KOH/g or more, in some examples an acidity of 80 mg KOH/g or more. The polymer having ester side groups may have an acidity of 100 mg KOH/g or less, in some examples 90 mg KOH/g or less. The polymer having ester side groups may have an acidity of 60 mg KOH/g to 90 mg KOH/g, in some examples 70 mg KOH/g to 80 mg KOH/g.

The polymer having ester side groups may have a melt flow rate of about 10 g/10 minutes to about 120 g/10 minutes, in some examples about 10 g/10 minutes to about 50 g/10 minutes, in some examples about 20 g/10 minutes to about 40 g/10 minutes, in some examples about 25 g/10 minutes to about 35 g/10 minutes.

The polymer, polymers, co-polymer or co-polymers of the resin can in some examples be selected from the Nucrel family of toners (e.g. Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, Bynell 2020 and Bynell 2022, (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)).

The resin can constitute about 5 to 90%, in some examples about 50 to 80%, by weight of the solids of the liquid electrophotographic composition and/or the varnish printed on the print substrate. The resin can constitute about 60 to 95%, in some examples about 70 to 95%, by weight of the solids of the liquid electrophotographic composition and/or the varnish printed on the print substrate.

Charge Director and Charge Adjuvant

The liquid electrophotographic composition and/or the varnish printed on the print substrate can comprise a charge director. A charge director can be added to an electrostatic composition to impart a charge of a desired polarity and/or maintain sufficient electrostatic charge on the particles of an electrostatic varnish composition. The charge director may comprise ionic compounds, including, but not limited to, metal salts of fatty acids, metal salts of sulfo-succinates, metal salts of oxyphosphates, metal salts of alkyl-benzene-sulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminium salts of sulfonic acid. The sulfonic acids may include, but are not limited to, alkyl sulfonic acids, aryl sulfonic acids, and sulfonic acids of alkyl succinates (e.g. see WO 2007/130069). The charge director can impart a negative charge or a positive charge on the resin-containing particles of an electrostatic varnish composition.

The charge director can comprise a sulfosuccinate moiety of the general formula $[R_a—O—C(O)CH_2CH(SO_3^-)C(O)—O—R_b]$, where each of $R_a$ and $R_b$ is an alkyl group. In some examples, the charge director comprises nanoparticles of a simple salt and a sulfosuccinate salt of the general formula $MA_n$, wherein M is a metal, n is the valence of M, and A is an ion of the general formula $[R_a—O—C(O)CH_2CH(SO_3)C(O)—O—R_b]$, where each of $R_a$ and $R_b$ is an alkyl group, or other charge directors as found in WO2007130069, which is incorporation herein by reference in its entirety. As described in WO2007130069, the sulfosuccinate salt of the general formula $MA_n$ is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, in some examples 2 nm or more. As described in WO2007130069, simple salts are salts that do not form micelles by themselves, although they may form a core for micelles with a micelle forming salt. The ions constructing the simple salts are all hydrophilic. The simple salt may comprise a cation selected from Mg, Ca, Ba, $NH_4$, tert-butyl ammonium, $Li^+$, and $Al^{+3}$, or from any sub-group thereof. The simple salt may comprise an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt may be selected from $CaCO_3$, $Ba_2TiO_3$, $A_2(SO_4)$, $A1(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $A_2(SO_4)_3$, $LiClO_4$ and $LiBF_4$, or any sub-group thereof. The charge director may further comprise basic barium petronate (BBP).

In the formula $[R_a—O—C(O)CH_2CH(SO_3^-)C(O)—O—R_b]$, in some examples, each of $R_a$ and $R_b$ is an aliphatic alkyl group. In some examples, each of $R_a$ and $R_b$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_a$ and $R_b$ are the same. In some examples, at least one of $R_a$ and $R_b$ is $C_{13}H_{27}$. In some examples, M is Na, K, Cs, Ca, or Ba. The formula $[R_a—O—C(O)CH_2CH(SO_3)C(O)—O—R_b]$ and/or the formula $MA_n$ may be as defined in any part of WO2007130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In an electrostatic varnish composition, the charge director can constitute about 0.001% to 20%, in some examples 0.01 to 20% by weight, in some examples 0.01 to 10% by weight, in some examples 0.01 to 1% by weight of the solids of the electrostatic varnish composition and/or varnish printed on the print substrate. The charge director can constitute about 0.001 to 0.15% by weight of the solids of the liquid electrophotographic varnish composition and/or varnish printed on the print substrate, in some examples 0.001 to 0.15%, in some examples 0.001 to 0.02% by weight of the solids of the liquid electrophotographic varnish composition and/or varnish printed on the print substrate. In some examples, the charge director imparts a negative charge on the electrostatic varnish composition. The particle conductivity may range from 50 to 500 pmho/cm, in some examples from 200-350 pmho/cm.

The liquid electrophotographic varnish composition and/or varnish printed on the print substrate can include a charge adjuvant. A charge adjuvant may be present with a charge director, and may be different to the charge director, and act to increase and/or stabilise the charge on particles, e.g. resin-containing particles, of an electrostatic composition. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g. Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock co-polymers of 2-ethylhexyl methacrylate-co-methacrylic acid calcium, and ammonium salts, co-polymers of an alkyl acrylamidoglycolate alkyl ether (e.g. methyl acrylamidoglycolate methyl ether-co-vinyl acetate), and hydroxy bis(3,5-di-tert-butyl salicylic) aluminate monohydrate. In some examples, the charge adjuvant is aluminium di and/or tristearate and/or aluminium di and/or tripalmitate.

The charge adjuvant can constitute about 0.1 to 5% by weight of the solids of the liquid electrophotographic varnish composition and/or varnish printed on the print substrate. The charge adjuvant can constitute about 0.5 to 4% by weight of the solids of the liquid electrophotographic varnish composition and/or varnish printed on the print substrate. The charge adjuvant can constitute about 1 to 3% by weight of the solids of the liquid electrophotographic varnish composition and/or varnish printed on the print substrate.

Other Additives

The electrostatic varnish composition may include an additive or a plurality of additives. The additive or plurality of additives may be added at any stage of the method. The additive or plurality of additives may be selected from a wax, a surfactant, biocides, organic solvents, viscosity modifiers, materials for pH adjustment, sequestering agents, preservatives, compatibility additives, emulsifiers and the like. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the varnish film to the print substrate, e.g. from an intermediate transfer member, which may be a heated blanket.

Method of Forming a Liquid Electrophotographic Varnish Composition

Also provided in an aspect is a method of manufacturing a liquid electrophotographic varnish composition, the method comprising mixing a carrier liquid, a polymer resin, an epoxy-based cross-linking agent; and a metal catalyst and/or a photo-initiator for catalysing the cross-linking, to form the liquid electrophotographic composition.

The method can include mixing the resin and the carrier liquid under appropriate conditions, in some examples in the presence of an epoxy-based cross-linking agent and a metal catalyst and/or a photo-initiator and/or a charge adjuvant, such as aluminium stearate, to form the particles including the resin, the cross-linking agent the metal catalyst and/or the photo-initiator. In some examples, the resin and carrier liquid may be mixed before the cross-linking agent and metal catalyst and/or a photo-initiator are added. The charge director may also be added at the time that the cross-linking agent and metal catalyst and/or a photo-initiator are added into the carrier liquid. The metal catalyst and/or the photoinitiator may be added after the resin, carrier liquid, epoxy-based cross-linking agent have been mixed. One or more further additives as described herein may be added at any time during the method. The steps described above are not intended to be bound by any particular order. For example, the mixing of the resin with the carrier liquid may be performed before, after, or concurrently with the step of combining the charge director and/or cross-linking agent with the carrier liquid. Additionally, the steps may be combined or performed in a different order as is known in the art. Additionally, the steps may include other necessary processing steps as is known in the art.

Printing Process and Print Substrate

Also provided is a method of electrophotographic printing, the method comprising printing the liquid electrophotographic varnish composition as described herein onto a substrate using a liquid electrophotographic printer.

In some examples, the surface on which the varnish layer is formed or developed may be on a rotating member, e.g. in the form of a cylinder. The surface on which the varnish is formed or developed may form part of a photo imaging plate (PIP). The method may involve passing the varnish composition between a stationary electrode and a rotating member, which may be a member having the surface having the (latent) electrostatic image thereon or a member in contact with the surface having the (latent) electrostatic image thereon. A voltage is applied between the stationary electrode and the rotating member, such that particles adhere to the surface of the rotating member. The intermediate transfer member, if present, may be a rotating flexible member, which may be heated, e.g. to a temperature of from 80 to 160° C.

In some examples, the varnish composition is printed onto the print substrate after a printed image has been printed. In some examples, the varnish composition is printed as a final separation, or print step, after all print separations relating to the image have been printed. References to print separation, or print step, are to be understood as referring to a single iteration of the three major transfer steps of the printing process: to transfer of a printing composition from the binary ink developer (BID) to the photo imaging plate (PIP), followed by $t_1$ transfer (or $1^{st}$ transfer) from the PIP to the intermediate transfer member (ITM), and finally $t_2$ transfer (or $2^{nd}$ transfer) from the ITM to the substrate. In CMYK printing, the ink formulations are printed in turn, or separately, hence print separations. In one example, the varnish composition is printed as a final separation after all CMYK ink separations have taken place, i.e. all inks have been transferred to the substrate. In one example, the varnish composition is printed simultaneously with the last ink separation.

During an electrostatic printing process, the intermediate transfer member operates at a temperature in the region of 100° C., for example about 105° C. In the example in which the cross-linking reaction is catalysed by the metal catalyst, this temperature is sufficient to activate the epoxy-based cross-linking agent and metal catalyst so that the varnish composition is at least partially cured, if not fully cured at the time that it is transferred to the print substrate.

In the example in which the cross-linking reaction is catalysed by UV radiation in the presence of a photoinitiator, the print substrate may be exposed to a UV irradiation source shortly after the varnish composition has been printed onto the substrate, and before image dryness.

Also provided in an aspect is a print substrate, having printed thereon an electrophotographic varnish composition comprising a polymer resin, a metal catalyst and/or a photoinitiator and an epoxy-based cross-linking agent such that the polymer resin is cross-linked.

The print substrate may be any suitable substrate. The substrate may be any suitable substrate capable of having an image printed thereon. The substrate may include a material selected from an organic or inorganic material. The material may include a natural polymeric material, e.g. cellulose. The material may include a synthetic polymeric material, e.g. a polymer formed from alkylene monomers, including, but not limited to, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the electrostatic ink composition and varnish composition are printed onto the print substrate.

EXAMPLES

The following illustrates examples of the methods and other aspects described herein. Thus, these Examples should not be considered as limitations of the present disclosure, but are merely in place to teach how to make examples of the present disclosure.

Materials

Resin:

Nucrel®925, Nucrel® 2806 and Bynel® 2022 resins are from DuPont and were used as received.

Low-Molecular Weight Epoxy-Based Crosslinkers:

3,4-Epoxycyclohexylmethyl 3,4-epoxycyclohexanecarboxylate ("di-epoxycyclohexane" or "DECH"), neopentyl glycol diglycidyl ether (NPGDGE), 4,4'-methylenebis(N,N-diglycidylaniline) (MBDGA), 1,2,7,8-diepoxyoctane (DEOC), resorcinol diglycidyl ether (RDGE), trimethylolpropane triglycidyl ether (TMPTGE), N,N-Diglycidyl-4-glycidyloxyaniline (DGGOA), tris(4-hydroxyphenyl)methane triglycidyl ether (THPMTGE), diglycidyl 1,2-cyclohexanedicarboxylate (DGCHDC), 1,4-Cyclohexanedimethanol diglycidyl ether (mixture of cis- and trans-) (CHDMDGE), tris(2,3-epoxypropyl) isocyanurate (TEPIC), bisphenol A diglycidyl ether (BPADGE), bisphenol A propoxylate diglycidyl ether (BAPDGE) were all of analytical grade and were purchased from Sigma-Aldrich (Rehovot, Israel).

High-Molecular Weight Epoxy-Based Crosslinkers:

Poly(ethylene-co-methyl acrylate-co-glycidyl methacrylate) [PEMAGM], poly[(phenyl glycidyl ether)-co-formaldehyde] [PPGE], poly(bisphenol A-co-epichlorohydrin), glycidyl end-capped [PBPADGE] (Mn~377 and 1,750), poly(ethylene-co-glycidyl methacrylate) [PEGM], poly[(o-cresyl glycidyl ether)-co-formaldehyde] [PCGE] (Mn=1,080), poly(dimethyl siloxane) diglycidyl ether terminated [PDMSDGE], poly(ethylene glycol) diglycidyl ether (PEGDGE, Mn=500), poly(propylene glycol) diglycidyl ether (PPGDGE, Mn=380 and 640) and Poly[dimethylsiloxane-co-(2-(3,4-epoxycyclohexyl)ethyl)methylsiloxane] P[DMS-co-ECHMS] are all of analytical grade and were purchased from Sigma-Aldrich (Rehovot, Israel).

Metal Catalysts:

NACURE XC-259 (Zinc-based catalyst, ~10% metal content) and K-PURE CXC-1765 (Zinc-based catalyst, ~7.5% metal content) were obtained from King Industries, Inc. (Norwalk, Conn., USA). HYCAT™ 2000S (Chromium-based salt catalyst, ~5% metal content) was obtained from Dimension Technologies Chemical Systems, Inc. (Fair Oaks, Calif., USA). Both NACURE series and HYCAT™ 2000S are freely soluble in isopar-L.

UV Curing:

ESACURE1064 photoinitiator (Lamberti, Gallarate, Italy) was applied for UV curing. The UV unit was a Fusion UV System equipped with a standard microwave powered lamp F 300, operating at approx. 120 Watt/cm. The conveyor belt, running under the UV lamp, was adjusted at a speed of 7.5 m/min. Curing by UV was conducted within few minutes after printing to avoid image dryness prior to curing.

Preparation of Varnish Dispersions

Paste Formation 720 grams of Nucrel® 925, 180 grams of Nucrel® 2806 and 100 grams of Bynel® 2022 were loaded into a Ross Mixer Paste. To this was added 1500 grams of isopar-L and the mixture was heated to 130° C. under constant mixing (100 rpm). After 3 h, the heating was ceased and the mixture was allowed to gradually cool to room temperature under constant mixing. A great care must be taken during paste formation to avoid phase separation. In a normal procedure, cooling is performed under constant mixing (50 rpm) and during at least 12-16 h. The percentage of the non-volatile solids (% NVS) in a typical paste is normally within a range of 41-43%.

Preparation of Varnish Solids:

1 Kg of the freshly-prepared paste, 1.3 Kg of isopar-L and 3.52 grams of the charge adjuvant (aluminum tristearate) were loaded into an attritor containing metal (or ceramic) grinding balls. The grinding process was performed at 30° C. (mixing speed of 250 rpm) for 12-15 hours. After that, grinding is ceased and a small sample from the ground was taken, dispersed in 0.1% BBP (in isopar-L) and measured by Malvern for particle size distribution. Grinding is terminated when the particle size reached 1 micron or below. After that, the ground is diluted with isopar-L, mixed for few hours and transferred to a receiving container. The % NVS of the obtained varnish is typically in the range of 10-13%.

Preparation of Varnish Working Dispersion (WD):

A typical varnish solids (10-13%, NVS) in a jerry can was allowed to mix in a shaker (200 rpm) for at least 24 h prior to processing. This shaking is crucial to break the sludge which often formed upon prolonged storage. A 3% NVS varnish is prepared by diluting a predetermined solid content with isopar-L. A typical WD contains solid varnish particles (3% NVS), Marcol (0.5 wt % to total weight of the WD, i.e. solid and isopar-L combined) and charge director (SCD). Typical SCD (charge director) content needed for charging is in the range of 2-15 mg per one gram of solid varnish. The WD is allowed to mix in a shaker (200 rpm) for at least 24 h prior to loading on the press to allow sufficient charging and homogenization.

Preparation of Varnish WD Containing 3,4-Epoxycyclohexylmethyl 3,4-Epoxycyclohexanecarboxylate (DECH) and Other Compatible (i.e. Dispersible in Isopar-L) and Low-Molecular Weight Epoxy-Based Crosslinkers:

3-10 wt % (to total solids in varnish) of DECH was added to a 3% NVS varnish WD. To this was added 0.5-1.0% (to total solids in varnish) of the corresponding metal catalyst (NACURE XC-259, K-PURE CXC-1765 or HYCAT™ 2000S) followed by the charge director (SCD) at 15 mg per one gram of varnish. The mixture, i.e. varnish plus epoxy plus catalyst, was allowed to mix in a shaker for at least 12 h to reach sufficient charging and homogenization. Similar formulation compositions were applied with other compatible and dispersible low-molecular weight epoxy-based crosslinker such as NPGDGE, DEOC, RDGE, TMPTGE, THPMTGE, DGCHDC, CHDMDGE, TEPIC, or BAPDGE, among others.

Preparation of Varnish WD Containing Incompatible (Largely Insoluble in Isopar-L) and Low-Molecular Weight Epoxy-Based Crosslinkers:

For incompatible low-molecular weight epoxy-based crosslinkers (e.g. MBDGA, DGGOA, RDGE, BPADGE, Araldite® 506), polymeric dispersant was used for dispersing the insoluble agents. 10 wt % solution of poly(ethylene-co-methyl acrylate-co-glycidyl methacrylate) (EMAGM) was prepared in isopar-L at 40° C. The dissolution of EMAGM is very slow and takes an average time of 12-16 h. Upon prolonged standing, EMAGM solution turns into a gel; however, it can easily re-dispersed by simply heating the mixture above 40° C. 5 grams of EMAGM (~50 grams of 10 wt %) was added to a 2 L reactor (Kinematica) equipped with high-shear mixer, thermocouple and mechanical mixer. To this was added 1 L of isopar-L and the mixture was heated to 40° C. to maintain a homogenous solution. In another flask, 5 grams of the isopar-incompatible cross linker (e.g. MBDGA) was dissolved in methyl ethyl ketone (MEK). The high-shear in the reactor was turned on at 10K rpm while keeping constant mechanical mixing (240 rpm). Under continuous high-shear and mechanical mixing, the MBDGA solution (in MEK) was added drop wise to the reactor mixture over 30 minutes. A sage-metering pump was used to maintain a constant and continuous rate of addition. Once the addition of the epoxy is completed, the mixture was kept under high-shear mixing for another 15 minutes at 40° C. The organic solvent, MEK, was removed completely under reduced pressure while keeping the mixture under high-shear conditions. Finally, the high-shear mixer was turned off and the mixture was cooled down to room temperature.

Preparation of Varnish WD Containing Compatible (i.e. Dispersible in Isopar-L) and High-Molecular Weight Epoxy-Based Crosslinkers:

5-20 wt % (to total solids in varnish) of the compatible epoxy-based polymeric material was added to a 3% NVS varnish WD. To this was added 0.5-1.0% (to total solids in ink) of the corresponding metal catalyst (NACURE XC-259, K-PURE CXC-1765 or HYCAT™ 2000S) followed by the charge director (SCD) at 15 mg per one gram of varnish. The mixture, i.e. varnish plus epoxy plus catalyst, was allowed to stand in a shaker for at least 12 h to reach sufficient charging and homogenization. Such epoxy-based polymeric materials include EMAGM, PDMSDGE, P[DMS-co-ECHMS], PEGDGE, and PPGDGE.

Results

FIG. 1 shows the debris weights (amount of image ink removed by the nail), obtained by the Taber® Shear instrument, for various varnish formulations printed on top of images (400% ink coverage) with different separation order: YYYK, YMCK and KCMY. Prints without the varnish are labeled as EI-4.5; prints with un-reactive varnish are labeled URV; prints with a thermally-reactive varnish formulation (containing 3% DECH cross-linker and 0.5% NACURE catalyst) are labeled TRV; and prints with a thermally and UV-reactive formulation (comprising 20 wt % DECH; 3% ESACURE1064 photoinitiator and 0.5% HYCAT2000S catalyst) are labeled UVRV. Reference UV formulation samples that have not been irradiated post printing are labelled as "w/o UV". It can be seen that TRV formulations and UVRV formulations provide more protection against scratch damage than un-varnished prints or prints with an un-reactive varnish.

The insets of FIG. 1 show the patter of damage (Taber® Shear) of four representative prints: (a) offset, (b) EI 4.5 with no varnish, (c) TRV, (d) UVRV, all printed as KCMY. As seen from these insets, print samples without the varnish showed the greatest damage where the carbide scratch tip was able to reach the substrate. Print samples with TRV and UVRV were more durable and scratch damage was almost invisible.

Figure 2:
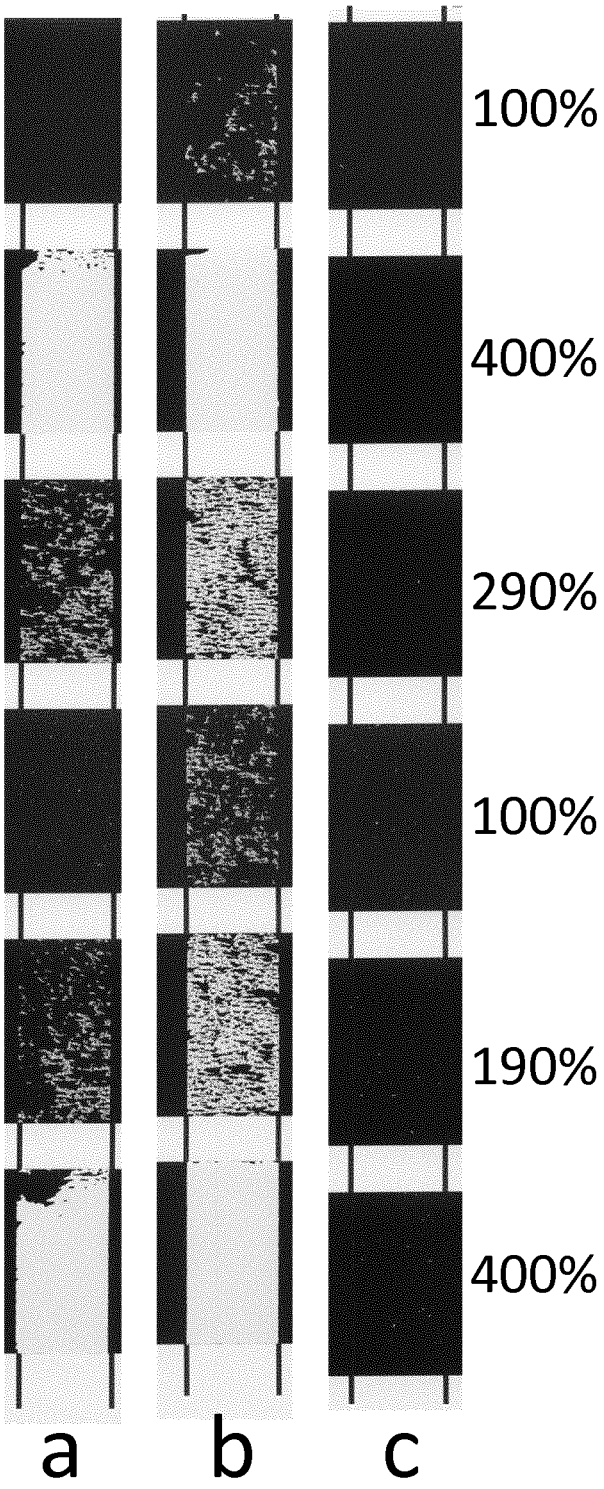
FIG. 2 shows the results of UV irradiation on peeling patterns for varnish formulations printed on top of images.

FIG. 2 shows the results of UV irradiation on peeling patterns. FIG. 2A shows the peeling patter of the reference print (without the varnish). FIG. 2B shows prints with varnish made from a varnish formulation (comprising the resin formulation as described above with 0.5% HYCAT2000S, 25 wt % DECH+3% ESACURE 106) that have not been irradiated, FIG. 2C shows the same formulation after UV irradiation. The UV-cured image showed a drastic improvement of peeling at all measured % coverage.

TABLE I

Chemical structures:
The crosslinker may be or comprise any of the following species.

| Chemical name | Abbreviation | Chemical structure |
|---|---|---|
| 3,4-Epoxycyclohexylmethyl 3,4-epoxycyclohexanecarboxylate | DECH | 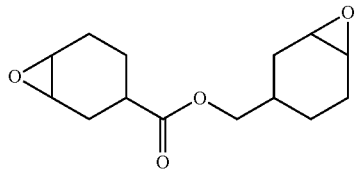 |
| 1,2,7,8-diepoxy octane | DEOC | 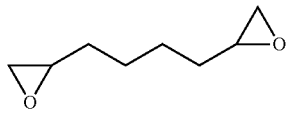 |
| trimethylolpropane triglycidyl ether | TMPTGE | 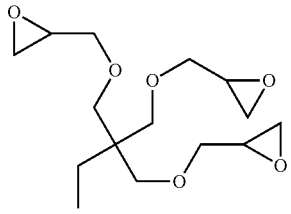 |
| resorcinol diglycidyl ether | RDGE | 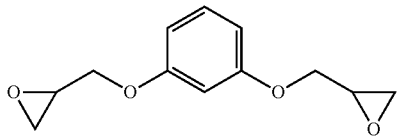 |
| N,N-Diglycidyl-4-glycidyloxyaniline | DGGOA | 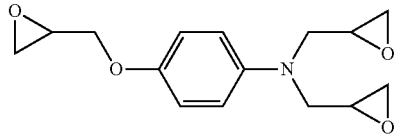 |
| 4,4'-Methylenebis(N,N-diglycidylaniline) | MBDGA | 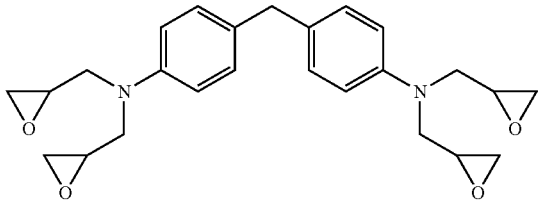 |

TABLE I-continued

| Chemical structures: The crosslinker may be or comprise any of the following species. | | |
|---|---|---|
| Chemical name | Abbreviation | Chemical structure |
| Tris(4-hydroxyphenyl)methane triglycidyl ether | THPMTGE | 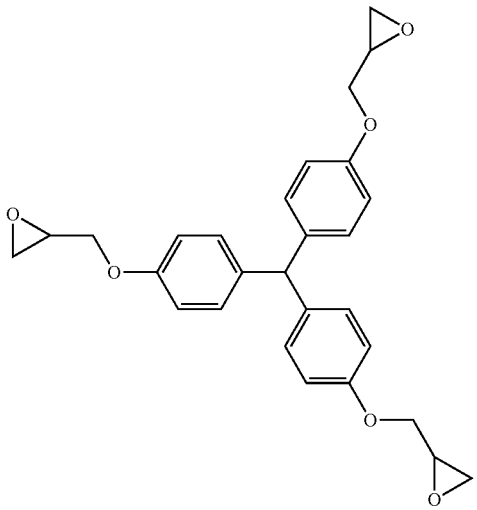 |
| diglycidyl 1,2-cyclohexanedicarboxylate | DGCHDC | 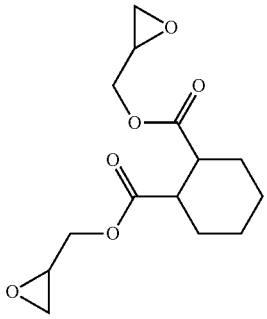 |
| 1,4-Cyclohexanedimethanol diglycidyl ether, mixture of cis and trans | CHDMDGE | 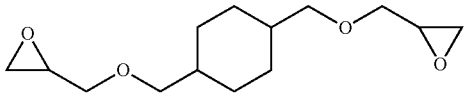 |
| Tris(2,3-epoxypropyl) isocyanurate | TEPIC | 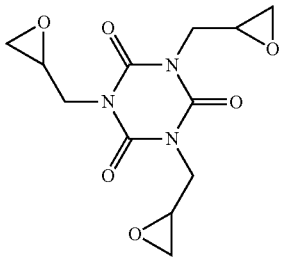 |
| Neopentyl glycol diglycidyl ether | NPGDGE | 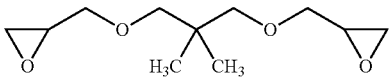 |
| Bisphenol A diglycidyl ether | BPADGE | 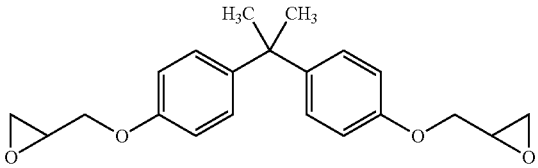 |

TABLE I-continued

| Chemical structures: The crosslinker may be or comprise any of the following species. | | |
|---|---|---|
| Chemical name | Abbreviation | Chemical structure |
| bisphenol A propoxylate diglycidyl ether | BAPDGE | 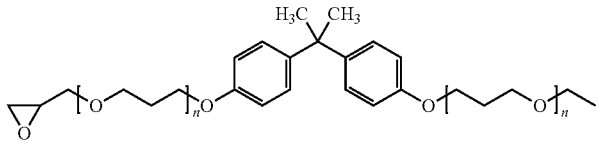 n = 1 |
| Poly(phenyl glycidyl ether)-co-formaldehyde | PPGE | 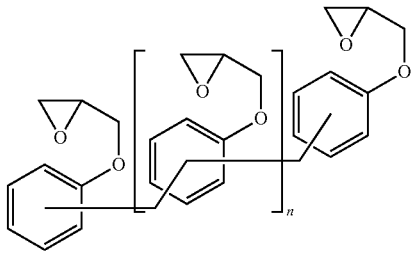 |
| poly[(o-cresyl glycidyl ether)-co-formaldehyde] | PCGE | 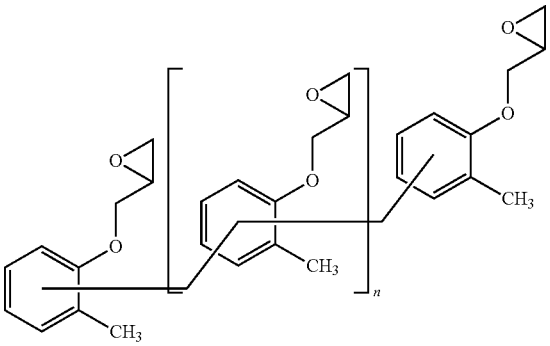 |
| Poly (ethylene-co-glycidyl methacrylate) | PEGM | 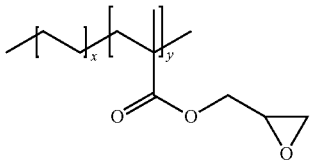 |
| Poly(ethylene-co-methyl acrylate-co-glycidyl methacrylate) | PEMAGM | 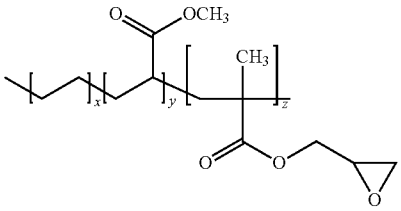 |
| poly(dimethyl siloxane) diglycidyl ether terminated | PDMSDGE | 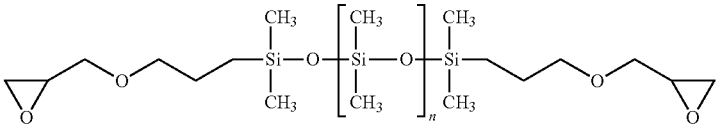 |
| poly(bisphenol A-co-epichlorohydrin) glycidyl end-capped | PBPADGE | 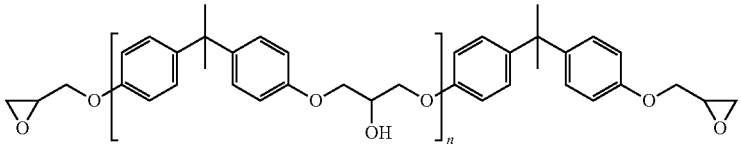 |

TABLE I-continued

| Chemical structures: The crosslinker may be or comprise any of the following species. | | |
|---|---|---|
| Chemical name | Abbreviation | Chemical structure |
| poly(ethylene glycol) diglycidyl ether | PEGDGE | 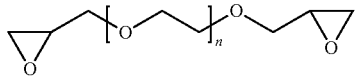 |
| poly(propylene glycol) diglycidyl ether) | PPGDGE | 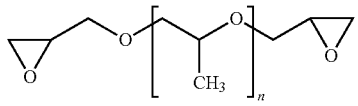 |
| Poly[dimethylsiloxane-co-(2-(3,4-epoxycyclohexyl)ethyl) methylsiloxane] | P[DMS-co-ECHMS] | 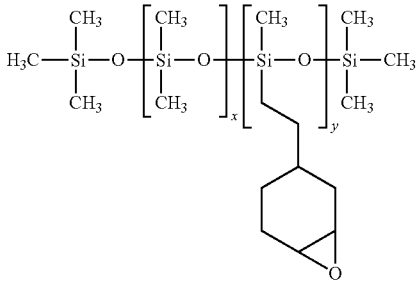 |

In the above formulae, 'n', 'x' 'y' and/or 'z' each independently represents an integer of 1 or more. 'n' x' 'y' and/or 'z' can be altered, depending, for example, on the desired molecular weight of the crosslinking agent.

While the methods, print substrates, printing systems and related aspects have been described with reference to certain examples, those skilled in the art will appreciate that various modifications, changes, omissions, and substitutions can be made without departing from the spirit of the disclosure. It is intended, therefore, that the methods, print substrates, printing systems and related aspects be limited by the scope of the following claims. The features of any dependent claim may be combined with the features of any of the independent claims or other dependent claims.

The invention claimed is:

1. A liquid electrophotographic varnish composition comprising:

a carrier liquid;

a polymer resin suspended as particles in the carrier liquid;

an epoxy-based cross-linking agent dispersed or dissolved directly in the carrier liquid; and a metal catalyst and/or a photo-initiator for catalysing cross-linking of the polymer resin;

wherein the liquid electrophotographic varnish composition is substantially colorless.

2. The liquid electrophotographic varnish composition according to claim 1, wherein the epoxy-based cross-linking agent is present in an amount of less than 10 wt %.

3. The liquid electrophotographic varnish composition according to claim 1, wherein the epoxy-based cross-linking agent is present in an amount of 6 wt % or less.

4. The liquid electrophotographic varnish composition according to claim 1, wherein the epoxy-based cross-linking agent has a molecular weight of 5000 Daltons or less.

5. A liquid electrophotographic varnish composition, comprising:

a polymer resin;

an epoxy-based cross-linking agent;

a metal catalyst and/or a photo-initiator for catalysing cross-linking of the polymer resin; and a carrier liquid;

wherein the epoxy-based cross-linking agent is of formula (I):

$$(X)—(Y—[Z—F]_m)_n \qquad \text{formula (I)}$$

wherein, in each $(Y—[Z—F]_m)_n$, Y, Z and F are each independently selected, such that:

F is an epoxide of the formula $CH(O)CR^1H$, wherein $R^1$ is selected from H and alkyl;

Z is alkylene;

Y is selected from (i) a single bond, —O—, —C(═O)—O—, or —O—C(═O)— and m is 1 or (ii) Y is $NH_{2-m}$ and m is 1 or 2;

n is at least 1;

and X is an organic group.

6. A liquid electrophotographic varnish composition, comprising:

a polymer resin;

an epoxy-based cross-linking agent;

a metal catalyst and/or a photo-initiator for catalysing cross-linking of the polymer resin; and a carrier liquid;

wherein the epoxy-based cross-linking agent is selected from the group consisting of 1,2,7,8-diepoxy octane, trimethylolpropane triglycidyl ether, resorcinol diglycidyl ether, N,N-diglycidyl-4-glycidyloxyaniline, 4,4'-Methylenebis(N,N-diglycidylaniline), tris(4-hydroxyphenyl)methane triglycidyl ether, diglycidyl 1,2-cyclohexanedicarboxylate, 1,4-cyclohexanedimethanol diglycidyl ether, tris(2,3-epoxypropyl) isocyanurate, neopentyl glycol diglycidyl ether, bisphenol A diglycidyl ether, bisphenol A propoxylate diglycidyl ether, 3,4-epoxycyclohexylmethyl 3,4-epoxycyclohexanecarboxylate, poly[(o-cresyl glycidyl ether)-co-formaldehyde], poly(ethylene-co-glycidyl methacrylate), poly(ethylene-co-methyl acrylate-co-glycidyl methacrylate), poly(bisphenol A-co-epichlorohydrin)

glycidyl end-capped, poly(ethylene glycol) diglycidyl ether, and poly(propylene glycol) diglycidyl ether.

7. The liquid electrophotographic varnish composition according to claim 1, wherein the liquid electrophotographic varnish composition includes the metal catalyst, and the metal catalyst comprises a chromium (III) complex or a zinc complex.

8. The liquid electrophotographic varnish composition according to claim 1, wherein the metal catalyst is present in an amount of less than 2 wt %.

9. The liquid electrophotographic varnish composition according to claim 1, wherein the liquid electrophotographic varnish composition includes the photo-initiator, and the photo-initiator comprises a cationic photo-initiator.

10. The liquid electrophotographic varnish composition according to claim 1, wherein the photo-initiator is present in an amount of less than 5 wt %.

11. The liquid electrophotographic varnish composition according to claim 1, wherein the polymer resin comprises a polymer having acidic side groups.

12. The liquid electrophotographic varnish composition according to claim 1, wherein the polymer resin comprises a polymer selected from the group consisting of (i) ethylene or propylene acrylic acid co-polymers and (ii) ethylene or propylene methacrylic acid co-polymers.

13. A method of manufacturing a liquid electrophotographic varnish composition, comprising:

mixing a carrier liquid and a polymer resin to form varnish solids;

mixing the varnish solids with additional carrier liquid and a charge director to form a working dispersion;

dispersing or dissolving an epoxy-based cross-linking agent in the working dispersion; and dispersing, in the working dispersion, a metal catalyst and/or a photo-initiator for catalysing cross-linking of the polymer resin, to form the liquid electrophotographic composition, wherein the liquid electrophotographic varnish composition is substantially colorless.

14. A method of electrophotographic printing, comprising printing the liquid electrophotographic varnish composition of claim 1 onto a substrate using a liquid electrophotographic printer.

15. A print substrate, having printed thereon the liquid electrophotographic varnish composition of claim 5.

16. The liquid electrophotographic varnish composition according to claim 1 wherein the epoxy-based cross-linking agent is selected from the group consisting of 1,2,7,8-diepoxy octane, trimethylolpropane triglycidyl ether, resorcinol diglycidyl ether, N,N-diglycidyl-4-glycidyloxyaniline, 4,4'-Methylenebis(N,N-diglycidylaniline), tris(4-hydroxyphenyl)methane triglycidyl ether, diglycidyl 1,2-cyclohexanedicarboxylate, 1,4-cyclohexanedimethanol diglycidyl ether, tris(2,3-epoxypropyl) isocyanurate, neopentyl glycol diglycidyl ether, bisphenol A diglycidyl ether, bisphenol A propoxylate diglycidyl ether, 3,4-epoxycyclohexylmethyl 3,4-epoxycyclohexanecarboxylate, poly(phenyl glycidyl ether)-co-formaldehyde, poly[(o-cresyl glycidyl ether)-co-formaldehyde], poly(ethylene-co-glycidyl methacrylate), poly(ethylene-co-methyl acrylate-co-glycidyl methacrylate), poly(dimethyl siloxane)diglycidyl ether terminated), poly(bisphenol A-co-epichlorohydrin) glycidyl end-capped, poly(ethylene glycol) diglycidyl ether, poly (propylene glycol) diglycidyl ether, and poly[dimethylsiloxane-co-(2-(3,4-epoxycyclohexyl)ethyl)methylsiloxane].

17. The method according to claim 15 wherein:

the epoxy-based cross-linking agent is selected from the group consisting of 3,4-Epoxycyclohexylmethyl 3,4-epoxycyclohexanecarboxylate, neopentyl glycol diglycidyl ether, 1,2,7,8-diepoxyoctane, resorcinol diglycidyl ether, trimethylolpropane triglycidyl ether, tris(4-hydroxyphenyl)methane triglycidyl ether, diglycidyl 1,2-cyclohexanedicarboxylate, 1,4-cyclohexanedimethanol diglycidyl ether (mixture of cis- and trans-), tris(2,3-epoxypropyl) isocyanurate, and bisphenol A propoxylate diglycidyl ether; and dispersing the epoxy-based cross-linking agent in the working dispersion involves adding the epoxy-based cross-linking agent to the working dispersion and mixing.

18. The method according to claim 15 wherein:

the epoxy-based cross-linking agent is selected from the group consisting of 4,4'-methylenebis(N,N-diglycidylaniline), N,N-Diglycidyl-4-glycidyloxyaniline, and bisphenol A diglycidyl ether; and dispersing the epoxy-based cross-linking agent in the working dispersion involves:

dispersing the epoxy-based cross-linking agent in a solution including a polymeric dispersant; and then adding the solution to the working dispersion and mixing.

19. The method according to claim 15 wherein:

the epoxy-based cross-linking agent is selected from the group consisting of poly(ethylene-co-methyl acrylate-co-glycidyl methacrylate), poly(dimethyl siloxane) diglycidyl ether terminated, poly(ethylene glycol) diglycidyl ether, poly(propylene glycol) diglycidyl ether, and poly[dimethylsiloxane-co-(2-(3,4-epoxycyclohexyl)ethyl)methylsiloxane]; and dispersing the epoxy-based cross-linking agent in the working dispersion involves adding the epoxy-based cross-linking agent to the working dispersion and mixing.

* * * * *